US008167641B2

(12) United States Patent
Thackston

(10) Patent No.: US 8,167,641 B2
(45) Date of Patent: May 1, 2012

(54) CONNECTOR AND MOUNTING ASSEMBLIES INCLUDING STRESS-DISTRIBUTION MEMBERS

(75) Inventor: Kevin Thackston, York, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 19 days.

(21) Appl. No.: 12/788,102

(22) Filed: May 26, 2010

(65) Prior Publication Data

US 2011/0294338 A1 Dec. 1, 2011

(51) Int. Cl.
*H01R 13/648* (2006.01)

(52) U.S. Cl. ..... 439/382; 439/384

(58) Field of Classification Search ..... 439/382, 439/384

See application file for complete search history.

(56) References Cited

U.S. PATENT DOCUMENTS 5,947,766 A * 9/1999 Tsuji et al. ..... 439/559
6,022,224 A * 2/2000 Peters ..... 439/66

OTHER PUBLICATIONS

ARINC 600 Connectors Product Line Information; Tyco Electronics; © 2010 Tyco Electronics All Rights Reserved, 2 pgs.

* cited by examiner

*Primary Examiner* — Renee Luebke
*Assistant Examiner* — Larisa Tsukerman

(57) ABSTRACT

A mounting assembly configured to mount a communication connector to a panel of an electrical system. The mounting assembly including a stress-distribution member that has an abutment surface abutting a flange of the connector. The stress-distribution member has a fastener opening. The mounting assembly also includes a fastener element that extends along a central axis. The fastener element has a cross-section taken perpendicular to the central axis that is sized and shaped to permit the fastener element to be freely inserted through through-holes of the connector and the panel. The fastener element is inserted into the fastener opening and secured to the fastener element. The stress-distribution member distributes mechanical energy provided by the fastener element when the connector is in a shock or vibration environment.

20 Claims, 4 Drawing Sheets

CONNECTOR AND MOUNTING ASSEMBLIES INCLUDING STRESS-DISTRIBUTION MEMBERS

BACKGROUND OF THE INVENTION

The subject matter herein relates generally to communication connectors, and more particularly, to communication connectors that operate in environments that experience substantial shock and vibration.

Communication connectors, such as electrical and/or optical connectors that transmit data signals or power, are used in various industries. In some cases, the communication connectors are configured to satisfy established standards for tolerating shock and vibration (e.g., MIL-STD-1344, methods 2004-1 and 2005-1 or similar standards for vibration and shock tolerance). For example, communication connectors identified as ARINC connectors conform to specifications established by Aeronautical Radio, Inc. ("ARINC"), which is a commercial standards group governing connectors, connector sizes, rack and panel configurations, etc, primarily for airborne applications.

In some known ARINC connectors, the ARINC connector is mounted to a panel of an electrical system. The electrical system may be located in an environment that frequently sustains substantial shock and vibration, such as aircraft or military applications. The ARINC connector includes a flange that extends from a connector body. The flange has a through-hole for mounting the ARINC connector to the panel. The through-hole is aligned with a through-hole of the panel. A screw is inserted through the through-holes and attached to a clinch nut that is mounted to the flange of the connector body. During operation, the ARINC connector may experience vibrations and shock that cause stress at one or more localized regions on the connector body and flange. For example, a region around the clinch nut may suffer from fatigue and failure due to stress raisers that exist because of the geometry and the load experienced by the region. A region where the flange extends from the connector body may also suffer from fatigue and failure due to stress raisers. During the lifetime of the ARINC connector, cracking or other indications of damage from fatigue may develop near the localized regions.

Although existing ARINC connectors are capable of enduring substantial shock and vibration for extended periods of time, there is a need for ARINC connectors and other communication connectors that are capable of experiencing greater levels of shock and vibration and/or for longer periods of time than known communication connectors. There is also a general need for reducing levels of stress experienced by certain regions of a communication connector and/or improving the lifetime of a communication connector.

BRIEF DESCRIPTION OF THE INVENTION

In one embodiment, a mounting assembly is provided that is configured to mount a communication connector to a panel of an electrical system. The mounting assembly including a stress-distribution member that has an abutment surface abutting a flange of the connector. The stress-distribution member has a fastener opening. The mounting assembly also includes a fastener element that extends along a central axis. The fastener element has a cross-section taken perpendicular to the central axis that is sized and shaped to permit the fastener element to be freely inserted through through-holes of the connector and the panel. The fastener element is inserted into the fastener opening and secured to the fastener element. The stress-distribution member distributes mechanical energy provided by the fastener element when the connector is in a shock or vibration environment.

Optionally, the stress-distribution member includes a stress plate that is confined within a restricted space such that the stress-distribution member is movable within the restricted space when the connector is experiencing shock or vibration. Furthermore, the stress-distribution member may be at least one of (a) rotatable about the central axis of the fastener element; (b) rotatable about a member axis that extends along the abutment surface; and (c) shiftable along the member or central axes when the connector is experiencing shock or vibration. Alternatively, the stress-distribution member includes a stress truss that is fixedly attached to the connector.

In another embodiment, a connector assembly is provided that includes a communication connector comprising a connector body and a flange projecting therefrom. The flange has opposite first and second flange surfaces and a through-hole extending therebetween. The connector assembly also includes a stress-distribution member that has an abutment surface that abuts the first flange surface. The stress-distribution member has a fastener opening aligned with the through-hole of the flange. The connector assembly further includes a fastener element that is inserted through the through-hole and into the fastener opening of the stress-distribution member. The through-hole is sized and shaped to permit the fastener element to be freely inserted through the through-hole. The fastener element is secured to the stress-distribution member. The stress-distribution member distributes mechanical energy provided by the fastener element when the connector is in a shock or vibration environment.

DETAILED DESCRIPTION OF THE INVENTION

Figure 1:
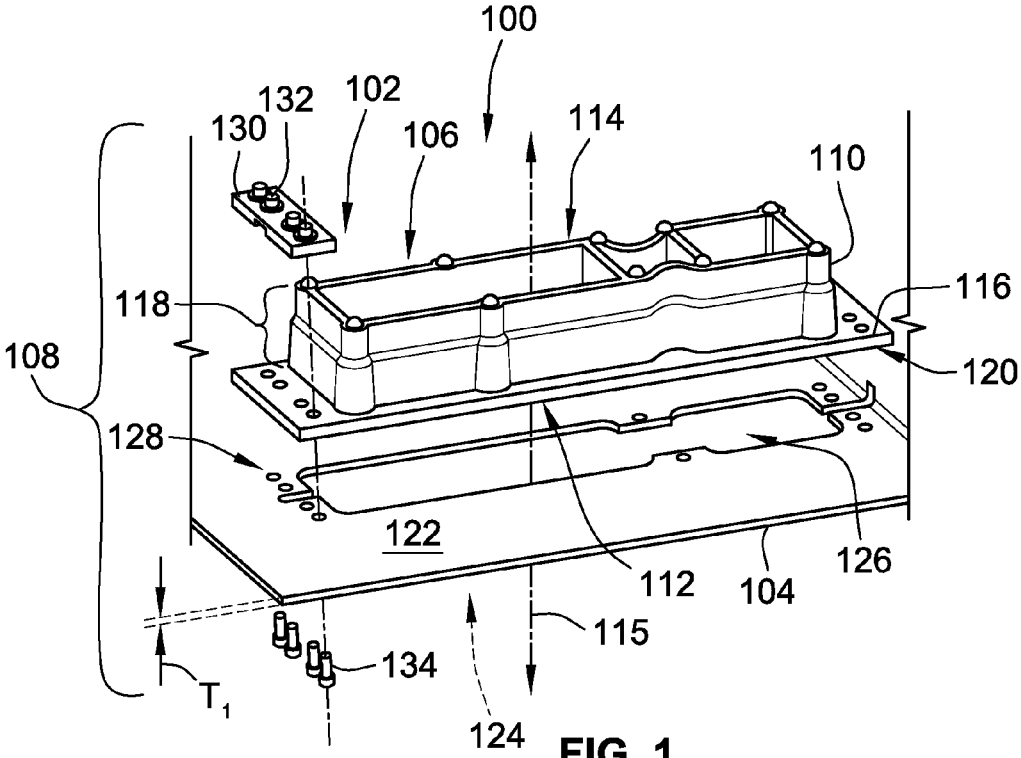
FIG. 1 is a partial view of an electrical system including a connector assembly formed in accordance with one embodiment.

FIG. 1 is a partial view of an electrical system 100 that includes a connector assembly 102 that is configured to be mounted to a panel 104 of the electrical system 100. The connector assembly 102 includes a communication connector 106 and a mounting assembly 108 that mounts the connector 106 to the panel 104. The connector 106 may be configured to engage a mating connector (not shown) of the electrical system 100 and electrically or optically transmit data signals and/or power therethrough. In the illustrated embodiment, the connector 106 is a ARINC connector configured for rack-and-panel type electrical systems. However, the types of communication connectors that may be used with embodiments described herein are not limited to ARINC connectors. The connector assembly 102 may be used in environments that frequently experience vibration and shock during operation. For example, the connector assembly 102 may be used in avionics or military applications. Accordingly, the connector assembly 102 may be configured to satisfy established standards for tolerating vibrations and shock. For example, the connector assembly 102 may be configured to at least substantially satisfy MIL-STD-1344 for vibration and shock tolerance. The connector assembly 102 may also be configured to substantially satisfy other similar standards for vibration and shock tolerance.

To this end, the mounting assembly 108 is configured to dampen mechanical energy experienced by the connector 106. For example, the mounting assembly 108 may absorb and distribute mechanical energy caused by vibrations or shock that occur during operation of the electrical system 100 or a larger system that includes the electrical system 100. In particular embodiments, the mechanical stress may be reduced or negated by the freedom of rotation or movability of a stress-distribution member 130. The stress-distribution member 130 is configured to distribute the stress experienced by the connector 106. The stress-distribution member 130 may also be referred to as a stress-distribution bracket in some embodiments.

The connector 106 includes a connector housing 110 having mating and loading ends 112 and 114 and a mating axis 115 extending therebetween. The mating end 112 is configured to be mounted to the panel 104 and engage the mating connector (not shown). The loading end 114 may couple to cables or conductors (not shown) through which data signals and/or power may be transmitted. In alternative embodiments, the loading end 114 engages the mating connector and the mating end 112 couples to the cables or conductors. The connector housing 110 includes a main body 118 that houses electrical or optical components (not shown) of the connector 106 and a flange 116 that projects away from the main body 118. The flange 116 may extend from the main body 118 in a lateral direction away from the mating axis 115 to an edge 120.

The panel 104 has opposite side surfaces 122 and 124 and a thickness $T_1$ extending therebetween. The panel 104 also has a plurality of openings that extend through the thickness $T_1$ of the panel 104 including a connector opening 126 and a plurality of fastener through-holes 128. The connector opening 126 is sized and shaped to receive the mating connector that engages the connector 106 or, in alternative embodiments, sized and shaped to receive cables or conductors that couple to the connector 106.

Also shown in FIG. 1, the mounting assembly 108 includes the stress-distribution member 130, a plurality of self-attaching grips 132, and a plurality of fastener elements 134. In the illustrated embodiment, the fastener elements 134 are threaded fasteners, such as screws. However, in alternative embodiments the fastener elements 134 may be other types of fasteners capable of securing to the stress-distribution member, such as plugs, posts, and the like.

When the connector assembly 102 is operatively assembled, the flange 116 is located between the panel 104 and the stress-distribution member 130, and the fastener elements 134 are inserted through corresponding fastener through-holes 128 and secured to the stress-distribution member 130. In the illustrated embodiment, the fastener elements 134 are secured to the stress-distribution member 130 through the self-attaching grips 132. However, the fastener elements 134 may be secured to the stress-distribution member 130 by other methods. For example, in alternative embodiments, the fastener elements 134 may be secured to the stress-distribution member 130 by being directly attached to the stress-distribution member 130 or by being integrally formed with the stress-distribution member 130. When the connector assembly 102 is operatively assembled, mechanical energy experienced by the fastener elements 134 may be absorbed by the stress-distribution member 130. The stress-distribution member 130 may distribute the mechanical energy throughout the stress-distribution member 130 so as to reduce the mechanical energy (e.g., shock, vibration, torque) experienced by the connector 106.

In the illustrated embodiment, the stress-distribution member 130 is a stress plate. The stress plate may substantially entirely cover the flange 116. However, in alternative embodiments, the stress-distribution member 130 may be other mechanical elements that facilitate distributing mechanical energy as described herein. For example, the stress-distribution member 130 may be a stress truss (shown in FIG. 6) that is fixedly attached to the connector 106. In some embodiments, the stress plate may also be fixedly attached to the connector 106.

Figure 2:
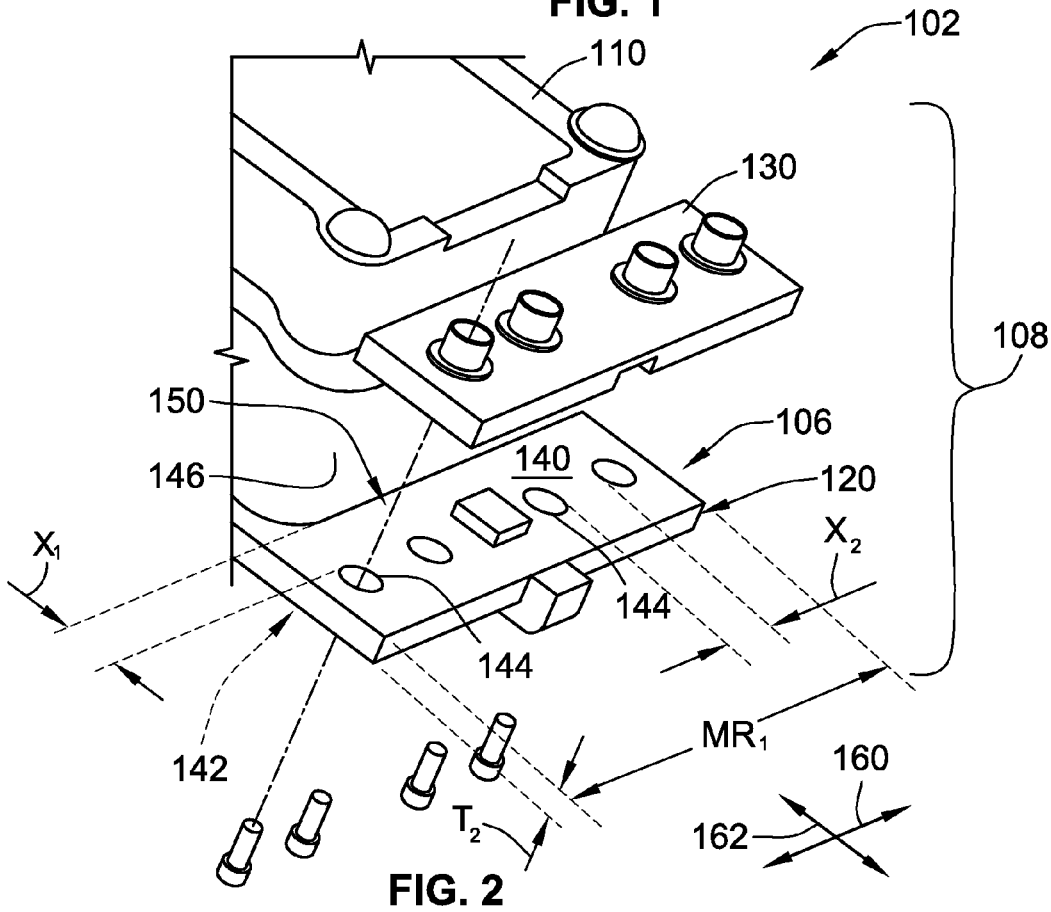
FIG. 2 is an exploded view of the connector assembly illustrating a mounting assembly formed in accordance with one embodiment.

FIG. 2 illustrates the mounting assembly 108 before the connector assembly 102 is operatively assembled. As shown, the flange 116 includes opposite first and second flange surfaces 140 and 142 and has a thickness $T_2$ extending therebetween. The first flange surface 140 extends parallel to lateral axes 160 and 162. The mating and lateral axes 115 (FIG. 1), 160, and 162 are mutually perpendicular to each other. In the illustrated embodiment, the thickness $T_2$ is substantially uniform as the flange 116 extends from a sidewall 146 of the connector housing 110 to the edge 120. The flange 116 forms a corner region 150 where the sidewall 146 joins the flange 116. In some known connectors, corner regions, such as the corner region 150, may be susceptible to damage caused by fatigue or stress raisers.

The flange 116 includes a plurality of flange through-holes 144 that extend through the thickness $T_2$. In the illustrated embodiment, the flange through-holes 144 are axially aligned with respect to each other along the lateral axis 160 that extends parallel to the sidewall 146. The flange through-holes 144 may be located in the flange 116 to facilitate distributing mechanical energy to reduce fatigue development. For example, the flange through-holes 144 may be equi-spaced from the sidewall 146 a distance $X_1$ measured along the lateral axis 162 and equi-spaced from each other a distance $X_2$ measured along the lateral axis 160. In alternative embodiments, the flange through-holes 144 may have other locations with respect to the sidewall 146 or with respect to each other.

Also shown in FIG. 2, the first flange surface 140 may include a mounting region $MR_1$ where the stress-distribution member 130 is mounted thereto. As will be described in greater detail below, the stress-distribution member 130 may press against the mounting region $MR_1$ to distribute the mechanical energy when the connector assembly 102 is experiencing shock or vibration. In particular embodiments, torque forces are translated into the stress-distribution member 130 thereby causing the stress-distribution member 130 to press against one or more portions of the mounting region $MR_1$. Furthermore, the stress-distribution member 130 may convert bending motions from the shock and vibration environment into compressive forces against the flange 116. This is unlike known connector assemblies that would exert a point load on the mounting region $MR_1$ at a distance away from the corner region 150.

Figure 3:
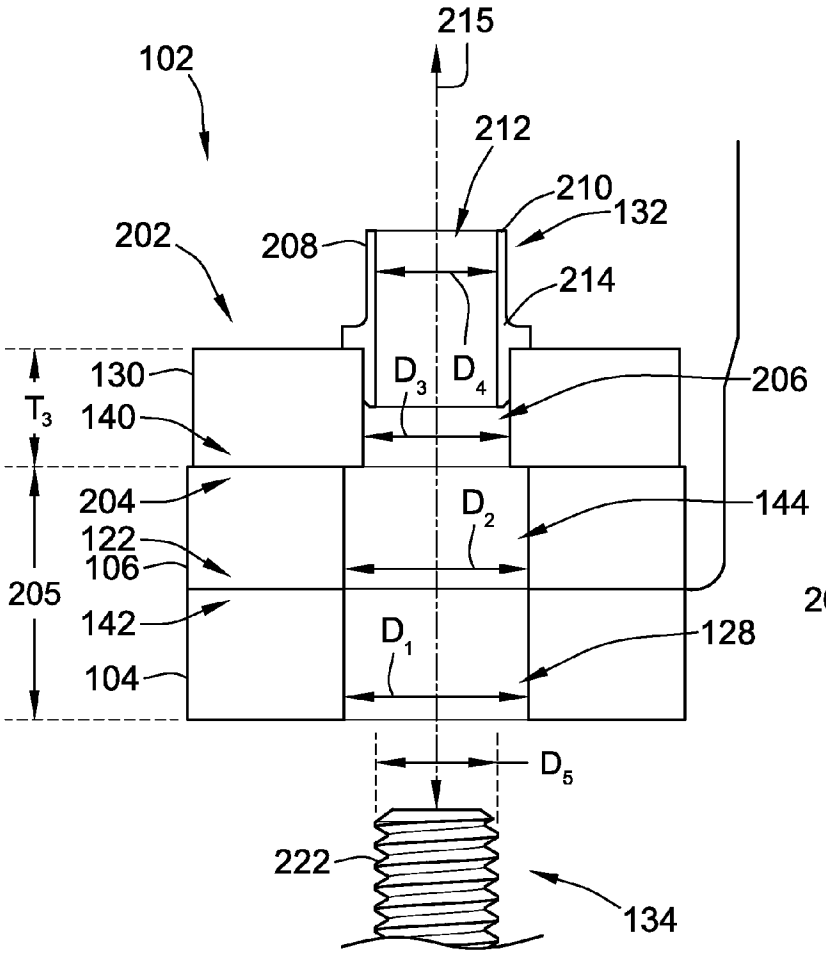
FIG. 3 is a side cross-section of the connector assembly shown in FIG. 2.

FIG. 3 is a side cross-section of the connector assembly 102. As shown, the stress-distribution member 130 has opposite surfaces (i.e., abutment surface 202 and member surface 204) and a thickness $T_3$ extending therebetween. The stress-distribution member 130 also includes a plurality of fastener openings 206 (only one fastener opening 206 is shown in FIG. 3) that extend through the thickness $T_3$. Similar to the flange through-holes 144 described with respect to FIG. 2, the fastener openings 206 may be axially aligned along the lateral axis 160.

When the connector assembly 102 is operatively assembled, the fastener openings 206 are aligned with corresponding flange through-holes 144 and the stress-distribution member 130 is mounted onto the mounting region $MR_1$ (FIG. 2) of the flange 116. As shown in FIG. 3, the through-holes 128 of the panel 104 are also aligned with the flange through-holes 144 and the fastener openings 206. The panel and flange through-holes 128 and 144 collectively form a mounting passage 205. The mounting passage 205 may be oriented with respect to a passage axis 215 that extends through the mounting passage 205 and the fastener opening 206 when the flange 116 is mounted thereto. The panel and flange through-holes 128 and 144 are concentric with respect to the passage axis 215. The mounting passage 205 is configured to receive the fastener element 134 inserted therethrough. (FIG. 3 only shows a leading end 222 of the fastener element 134.)

Before or after the stress-distribution member 130 is mounted to the mounting region $MR_1$, the self-attaching grips 132 may engage the fastener openings 206 on the abutment surface 202. The self-attaching grips 132 are configured to be secured to the fastener elements 134. As shown, the self-attaching grip 132 has a shell 208 including a wall 210 that defines a grip passage 212 extending therethrough. The wall 210 has interior and exterior surfaces. In the illustrated embodiment, the interior surfaces are threaded to engage a threaded fastener (e.g., screw). Also shown, the exterior surface may have a rim 214 projecting radially away from the passage axis 215. The rim 214 is configured to engage the abutment surface 202 so that the self-attaching grip 132 is not inadvertently removed from the stress-distribution member 130 when the connector assembly 102 is operatively assembled. For example, the rim 214 may engage the abutment surface 202 through an interference or snap fit. In the illustrated embodiment, the self-attaching grips 132 include clinch nuts.

As shown in FIG. 3, the self-attaching grips 132, the stress-distribution member 130, the flange 116, and the panel 104 may be stacked with respect to each other along the mating axis 115 (FIG. 1). When stacked together, the member surface 204 abuts the flange surface 140. The member surface 204 and the flange surface 140 may extend alongside each other and contact each other. Likewise, the flange surface 142 may abut the side surface 122 of the panel 104.

Furthermore, when stacked together, the grip passage 212, the fastener opening 206, the flange through-hole 144, and the panel through-hole 128 are concentrically aligned with respect to the passage axis 215. The flange and panel through-holes 144 and 128 may each have cross-sections taken perpendicular to the passage axis 215 that are larger than cross-sections of the fastener opening 206 and/or the grip passage 212. For example, in the illustrated embodiment, the panel through-hole 128 has a diameter $D_1$ measured perpendicular to the passage axis 215, and the flange through-hole 144 has a diameter $D_2$. The diameters $D_1$ and $D_2$ may be substantially equal. The fastener opening 206 has a diameter $D_3$ that is less than the diameters $D_1$ and $D_2$. In alternative embodiments, the diameter $D_3$ is substantially equal to the diameters $D_1$ and $D_2$. Furthermore, the grip passage 212 has a diameter $D_4$ that is also less than the diameters $D_1$ and $D_2$. In the illustrated embodiment, the diameter $D_4$ is also less than the diameter $D_3$.

In alternative embodiments, the self-attaching grip 132 is not required and other methods of securing the fastener element 134 to the stress-distribution member 130 may be used. For example, the fastener element 134 may directly attach to the fastener openings 206. In such embodiments, the fastener element 134 may engage interior surfaces of the fastener opening 206 through a threaded engagement or an interference fit. The fastener opening 206 may extend completely through the thickness $T_3$ of the stress-distribution member 130 or only a portion of the thickness $T_3$. Furthermore, in alternative embodiments, the fastener element(s) 134 may be integrally formed with the stress-distribution member 130. In such embodiments, the fastener elements 134 may be inserted through the flange 116 and the panel 128 in a direction from the first flange surface 140 to the second flange surface 142. As such, the self-attaching grip 132 is an optional component.

Figure 4:
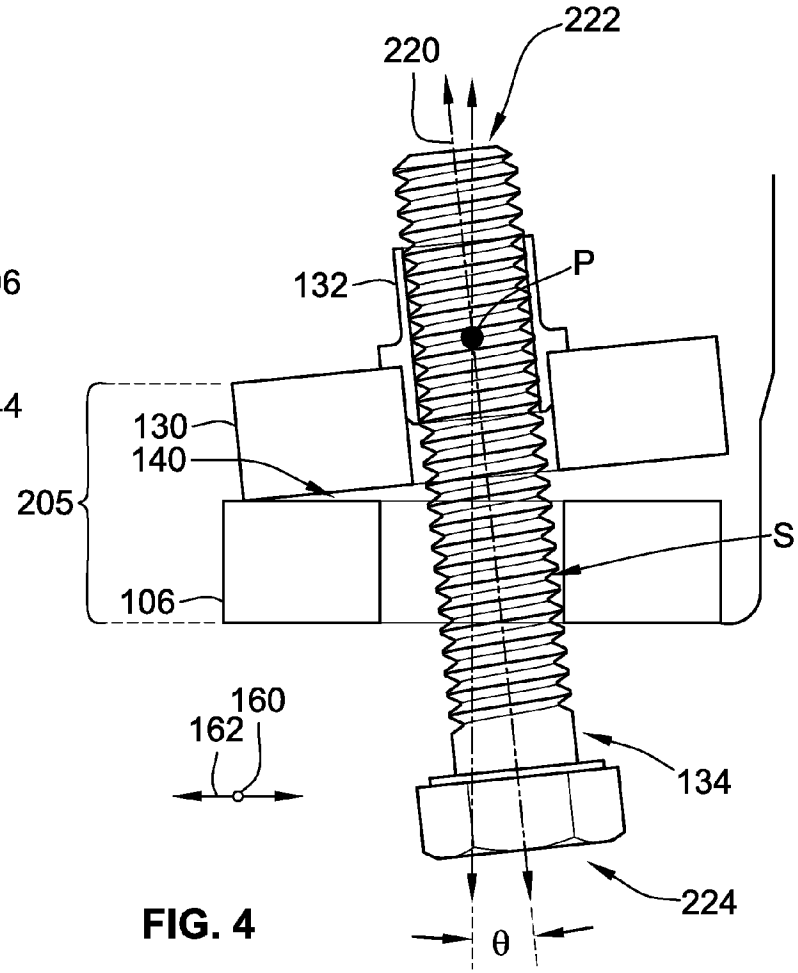
FIG. 4 is a side cross-section of the connector assembly when the connector assembly is experiencing shock or vibration.

FIG. 4 is a side cross-section of the connector assembly 102 when the connector assembly 102 is experiencing shock or vibration. In the illustrated embodiment, the fastener element 134 includes an elongated body that extends along a central longitudinal axis 220 between the leading end 222 and a trailing end 224. The leading end 222 is configured to be secured to the self-attaching grip 132 in the exemplary embodiment. Furthermore, the fastener element 134 may have a cross-section taken perpendicular to the longitudinal axis 220 that is sized and shaped to permit the fastener element 134 to be freely inserted through the panel and flange through-holes 128 and 144 (FIG. 3) (i.e., the mounting passage 205). As used herein, the phrase "freely inserted" means that the fastener element 134 may be advanced through the mounting passage 205 without catching interior surfaces of the panel and flange through-holes 128 and 144 or being prevented from advancing therethrough when the fastener element 134 is oriented such that the longitudinal axis 220 and the passage axis 215 coincide with each other. For example, the fastener element 134 does not form a threaded engagement with the mounting passage 205.

The fastener element may clear the flange and panel through-holes 144 and 128 when the fastener element 134 is advanced through the mounting passage 205. For example, the fastener element 134 may have a diameter $D_5$ (shown in FIG. 3) that is sized to engage the self-attaching grip 132. The fastener element 134 may form a threaded engagement or an interference fit with the self-attaching grip 132. The diameter $D_5$ may be less than the diameters $D_1$ and $D_2$ (FIG. 3) such that the spacing S exists between the exterior surface of the fastener element 134 and the interior surfaces of the panel and flange through-holes 128 and 144. The spacing S may be calculated as a difference between the diameter $D_5$ and the smallest of the diameters $D_1$ and $D_2$. In some embodiments, the diameter $D_5$ is also less than the diameter $D_3$ of the fastener opening 206 (FIG. 3).

FIG. 4 is an exaggerated representation of what occurs when the stress-distribution member 130, the flange 116, and the fastener element 134 experience shock and vibration during normal usage. In particular embodiments, when the connector assembly 102 is operatively assembled, the cross-sections of the flange and panel through-holes 144 and 128 are sized and shaped to permit the fastener element 134 to move within the mounting passage 205. The fastener element 134 may also be characterized as floating within mounting passage 205 or corresponding through-holes. Accordingly, the stress-distribution member 130 may also be characterized as movable with respect to the flange 116. For example, as shown in FIG. 4, the fastener element 134 may be rotatable about a pivot region P such that the longitudinal axis 220 and the passage axis 215 would form a small non-orthogonal angle θ if the axes intersected each other. As shown, the central axis is 220 may form a non-orthogonal angle θ with respect to the passage axis 215. The non-orthogonal angle θ may be, for example, less than or equal to 10° or, in more particular embodiments, less than or equal to 5°. In even more particular embodiments, the non-orthogonal angle is less than or equal to 3° or less than or equal to 1°.

Furthermore, the fastener element 134 may also move within the mounting passage 205 by shifting in a lateral direction along the lateral axis 160 or the lateral axis 162 (FIG. 2). For example, the stress-distribution member 130 may slide along the flange surface 140 in one of the lateral directions thereby moving the fastener element 134 within the mounting passage 205. The longitudinal axis 220 of the fastener element 134 may remain parallel to the passage axis 215 or the longitudinal axis 220 may rotate as described above. In particular embodiments, the fastener element 134 may shift a distance that is equal to the spacing S.

Figure 5:
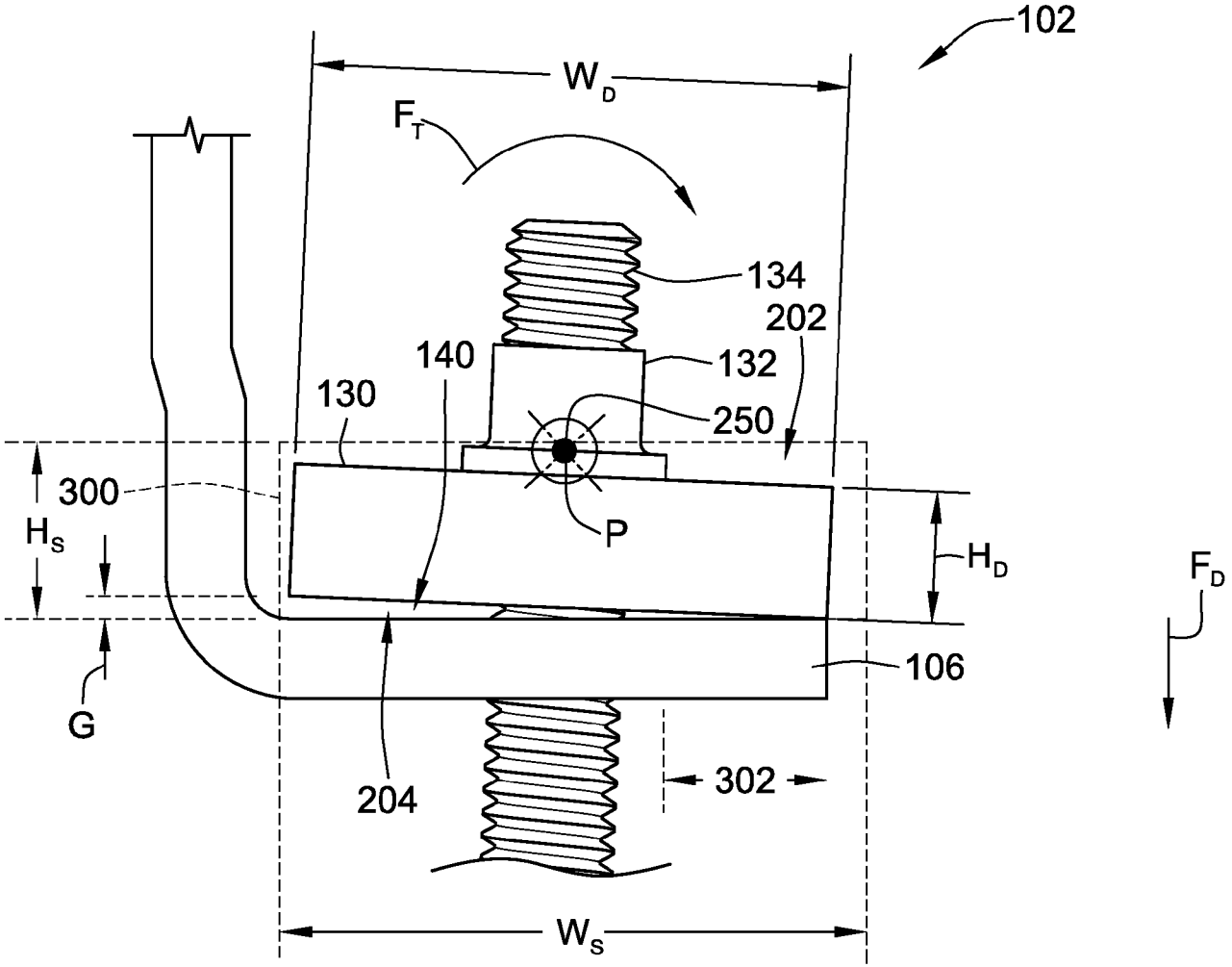
FIG. 5 is a side view of the connector assembly of FIG. 1 in a shock or vibration environment.

FIG. 5 is a side view of the connector assembly 102 illustrating the connector assembly 102 in a shock or vibration environment. As described above, the fastener element 134 and the stress-distribution member 130 may be movable with respect to the flange 116. Accordingly, the stress-distribution member 130 may be confined within a restricted space 300 (indicated by dashed lines) in a shock or vibration environment. The restricted space 300 may be slightly larger than a spatial volume of the stress-distribution member 130 and may be located adjacent to the flange 116. For example, the restricted space 300 may have a height $H_S$ that is equal to a height $H_D$ of the stress-distribution member 130 when the fastener element 134 is fully rotated within the mounting passage 205 as shown in FIG. 5. The restricted space 300 may have a width $W_S$ and a length (not shown) that is equal to a spatial volume in which the stress-distribution member 130 may shift. For example, the width $W_S$ of the restricted space 300 may be substantially equal to a width $W_D$ of the stress-distribution member 130 plus twice the spacing S. Likewise, the length of the restricted space 300 may be substantially equal to a length (not shown) of the stress-distribution member 130 plus twice the spacing S. The stress-distribution member 130 is movable within the restricted space 300 with respect to the flange 116.

Furthermore, when experiencing shock or vibration, the fastener element 134 may translate the mechanical energy to the stress-distribution member 130. The stress-distribution member 130 may absorb and distribute the mechanical energy about the mounting region $MR_1$ (FIG. 2) of the flange 116. In particular embodiments, the fastener element 134 provides a torque force $F_T$ about a pivot region P. In some embodiments, the torque force $F_T$ defines at least a portion of the mechanical energy received by the stress-distribution member 130. The torque force $F_T$ is experienced by the stress-distribution member 130 proximate to the fastener opening 206 (FIG. 3) when the connector assembly 102 is experiencing shock or vibration. The pivot region P is a general region that indicates where the fastener element 134 is secured to the stress-distribution member 130. The pivot region P may be proximate to the fastener opening 206. The torque force $F_T$ may be about any axis that extends parallel to the member surface 204 and through the pivot region P.

The torque force $F_T$ may cause the stress-distribution member 130 to press against the flange 116 based upon a direction of the force $F_T$. By way of example, as indicated by the arrow $F_D$, a portion 302 of the stress-distribution member 130 may press against a portion of the flange 116 that abuts the portion 302. More specifically, the portion 302 extends along the member surface 204 and presses against a corresponding portion of the flange surface 140. Accordingly, unlike known connector assemblies, the mechanical energy is distributed by the stress-distribution member 130 such that the mechanical energy is not concentrated within a localized region of the flange 116. Such embodiments may reduce fatigue development by the flange 116.

As described above, the fastener element 134 may not be rigidly mounted to the flange 116 and may be slightly moveable with respect to the flange 116. For example, the stress-distribution member 130 may be slightly rotated about a member axis 250 that extends through the pivot region P and along the abutment surface 202. A gap G may be formed between the member surface 204 and the flange surface 140. In alternative embodiments, the stress-distribution member 130 may be fixedly attached to the flange 116 or connector 106 by the fastener element 134.

Accordingly, in particular embodiments, the stress-distribution member 130 may be at least one of (a) rotatable about the longitudinal axis 220 (FIG. 4) of the fastener element 134, (b) rotatable about the member axis 250 that extends along the abutment surface 202, and (c) shiftable along the member or longitudinal axes 250 and 220 when the connector 106 is experiencing shock or vibration.

Figure 6:
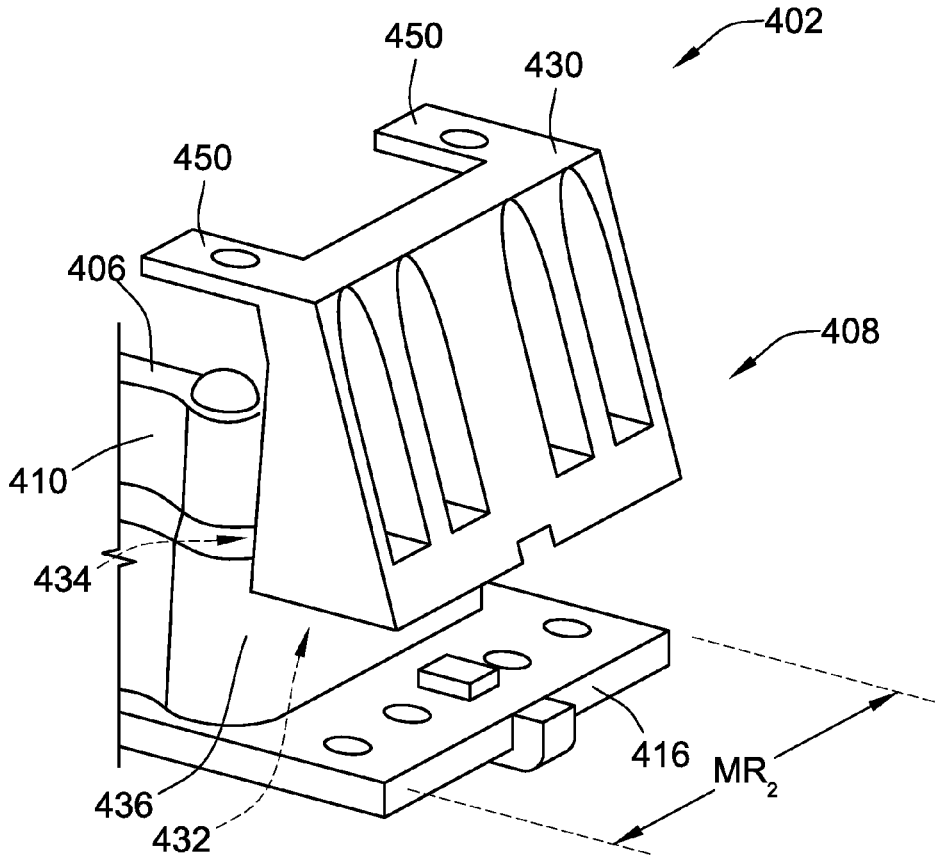
FIG. 6 is an exploded perspective view of a connector assembly including a mounting assembly formed in accordance with an alternative embodiment.
Figure 7:
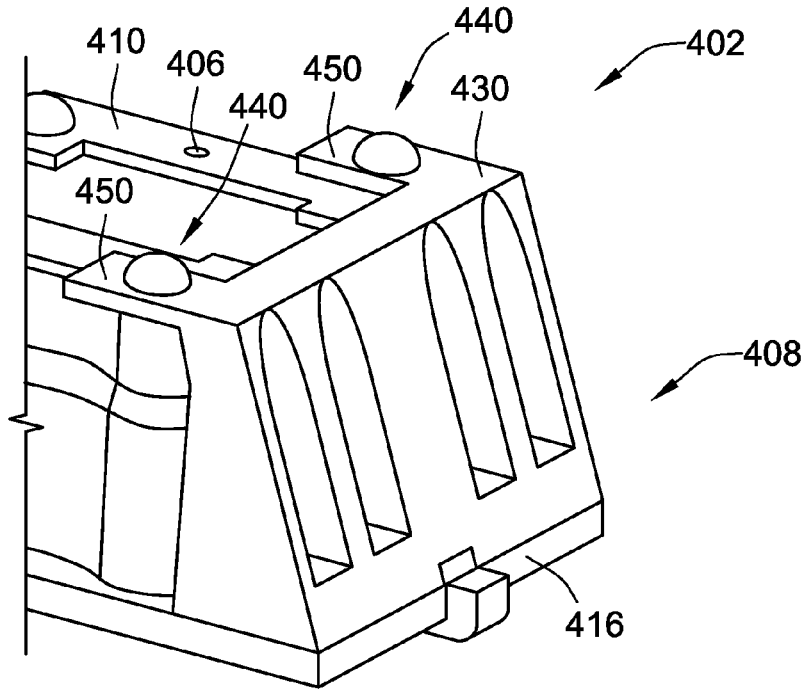
FIG. 7 is an assembled perspective view of the connector assembly shown in FIG. 6

FIGS. 6 and 7 illustrate an exploded perspective view and an assembled perspective view of a connector assembly 402. The connector assembly 402 may have similar features as the connector assembly 102 (FIG. 1). As shown, the connector assembly 402 includes a communication connector 406 and a mounting assembly 408. The connector 406 includes a main body 410 and a flange 416 projecting radially therefrom. The flange 416 has a mounting region $MR_2$. The mounting assembly 408 includes a stress-distribution member 430 and a plurality of fastener elements (not shown). The fastener elements may be similar to the fastener elements 134 (FIG. 1) described above.

The stress-distribution member 430 includes an abutment surface 432 (FIG. 6) that is configured to be mounted to the mounting region $MR_2$ (FIG. 6). The stress-distribution member 430 also includes a wall-engaging surface 434 that abuts a sidewall 436 of the main body 410. Unlike the stress-distribution member 130, the stress-distribution member 430 is fixedly attached to the connector 106. More specifically, the stress-distribution member 430 may affix to the main body 410 of the connector 406 at one or more points 440. For example, the stress-distribution member 430 includes projections 450 that are secured to a loading end 414 of the connector 406. When assembled, the fastener elements are secured to the stress-distribution member 430. In the illustrated embodiment, the stress-distribution member 430 is a stress truss. Accordingly, mechanical energy transferred by the fastener elements is absorbed by the stress-distribution member 430.

It is to be understood that the above description is intended to be illustrative, and not restrictive. For example, the above-described embodiments (and/or aspects thereof) may be used in combination with each other. Furthermore, dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a communication connector comprising a main body and a flange projecting therefrom, the flange having opposite first and second flange surfaces and a flange through-hole extending therebetween;

a stress-distribution member having a member surface that abuts the first flange surface, the stress-distribution member having a fastener opening aligned with the flange through-hole of the flange;

a fastener element inserted through the flange through-hole and into the fastener opening of the stress-distribution member, the flange through-hole being sized and shaped to permit the fastener element to be freely inserted therethrough, the fastener element being secured to the stress-distribution member, the stress-distribution member distributing mechanical energy provided by the fastener element when the connector is in a shock or vibration environment;

wherein a cross-section of the fastener element is less than a cross-section of the through-hole such that a spacing exists between an exterior surface of the fastener element and an interior surface of the through-hole, the fastener element being floatable within the through-hole when experiencing shock or vibration.

2. The connector assembly of claim 1, wherein the fastener element provides a torque force proximate to the fastener opening of the stress-distribution member, the torque force defining at least some of the mechanical energy experienced by the stress-distribution member.

3. The connector assembly of claim 2, wherein the stress-distribution member presses against a portion of the flange that abuts a portion of the stress-distribution member when the torque force is experienced by the stress-distribution member.

4. The connector assembly of claim 1, wherein the stress-distribution member is confined within a restricted space located adjacent to the flange, the stress-distribution member being movable within the restricted space with respect to the flange when the connector is experiencing shock or vibration.

5. The connector assembly of claim 4, wherein the stress-distribution member is at least one of (a) rotatable about the central axis of the fastener element;

(b) rotatable about a member axis that extends along the member surface; or (c) shiftable along the member axis when the connector is experiencing shock or vibration.

6. The connector assembly of claim 1, wherein the fastener opening comprises a plurality of the fastener openings and the fastener element comprises a plurality of the fastener elements, the fastener openings being distributed along the stress-distribution member.

7. The connector assembly of claim 1, further comprising a self-attaching grip mounted to the stress-distribution member, the self-attaching grip including a grip passage extending therethrough and being aligned with the fastener hole, the self-attaching grip being secured to the fastener element thereby securing the fastener element to the stress-distribution member.

8. The connector assembly of claim 1, wherein the stress-distribution member comprises a stress plate that presses against the flange when experiencing shock or vibration, the stress plate comprising a rigid material.

9. The connector assembly of claim 1, wherein the stress-distribution member converts bending motions from the shock and vibration environment into compressive forces against the flange.

10. A connector assembly comprising:

a communication connector comprising a connector housing having a through-hole;

a stress-distribution member having a member surface that abuts and is in direct contact with the connector housing, the stress-distribution member having a fastener opening that aligns with the through-hole; and a fastener element extending along a central axis, the through-hole being sized and shaped to permit the fastener element to be freely inserted therethrough, the fastener element being inserted into the fastener opening and secured to the stress-distribution member, the stress-distribution member distributing mechanical energy provided by the fastener element when the connector is in a shock or vibration environment, wherein a gap is intermittently formed between the member surface and the connector housing when the connector is in the shock or vibration environment, the member surface facing in a direction along the central axis.

11. The connector assembly of claim 10, wherein the fastener element provides a torque force proximate to the fastener opening of the stress-distribution member, the torque force defining at least some of the mechanical energy experienced by the stress-distribution member.

12. The connector assembly of claim 11, wherein the stress-distribution member presses against a portion of the connector housing that abuts a portion of the stress-distribution member when the torque force is experienced by the stress-distribution member.

13. The connector assembly of claim 10, wherein the stress-distribution member is confined within a restricted space located adjacent to the connector housing, the stress-distribution member being movable within the restricted space with respect to the connector housing when the connector is experiencing shock or vibration.

14. The connector assembly of claim 13, wherein the stress-distribution member is at least one of (a) rotatable about the central axis of the fastener element; or (b) rotatable about a member axis that extends along the member surface.

15. The connector assembly of claim 10, wherein the stress-distribution member comprises a stress plate that presses against the connector housing when experiencing shock or vibration, the stress plate comprising a rigid material.

16. The connector assembly of claim 10, wherein a cross-section of the fastener element is less than a cross-section of the through-hole such that a spacing exists between an exterior surface of the fastener element and an interior surface of the through-hole, the fastener element being floatable within the through-hole when experiencing shock or vibration.

17. The connector assembly of claim 10, wherein the connector housing includes a plurality of the through-holes, the stress-distribution member includes a plurality of the fastener openings, and the connector assembly includes a plurality of the fastener elements, each fastener element being inserted through one flange through-hole and secured to the stress-distribution member.

18. A mounting assembly for mounting a communication connector to a panel, the mounting assembly comprising:

a stress-distribution member having an abutment surface that abuts a flange of the communication connector, the stress-distribution member having a fastener opening; and a fastener element extending along a central axis, the fastener element having a cross-section taken perpendicular to the central axis that is sized and shaped to permit the fastener element to be freely inserted through through-holes of the connector and the panel, the fastener element being inserted into the fastener opening and secured to the stress-distribution member, the stress-distribution member distributing mechanical energy provided by the fastener element when the connector is in a shock or vibration environment;

wherein the stress-distribution member comprises a stress truss, the truss being configured to fixedly attach to the connector over a loading end of the connector.

19. The mounting assembly of claim 18, further comprising the connector, the connector including a main body and a flange projecting from a sidewall of the main body, wherein the stress-distribution member further comprises a wall-engaging surface, the wall-engaging surface abutting at least a portion of the sidewall.

20. The mounting assembly of claim 19, wherein the stress truss is secured to the connector at a plurality of points along the flange and the main body.

* * * * *